US005820456A

United States Patent [19]

Nelson

[11] Patent Number: 5,820,456

[45] Date of Patent: Oct. 13, 1998

[54] PAINT SPRAY BOOTH

[75] Inventor: Thomas L. Nelson, Covington, Ga.

[73] Assignees: Sandy J. Pangle, Cohutta; Robert B. Kennedy, Atlanta, both of Ga.; part interest to each

[21] Appl. No.: 735,654

[22] Filed: Oct. 24, 1996

[51] Int. Cl.[6] ..... B05B 15/12

[52] U.S. Cl. ..... 454/52; 454/50; 454/238

[58] Field of Search ..... 454/50, 51, 52, 454/238; 118/326

[56] References Cited

U.S. PATENT DOCUMENTS

| | | | |
|---|---|---|---|
| 4,261,256 | 4/1981 | Joret | 454/52 X |
| 4,685,385 | 8/1987 | Rich . | |
| 4,721,033 | 1/1988 | Bloomer et al. . | |
| 4,729,295 | 3/1988 | Osawa et al. . | |
| 4,840,116 | 6/1989 | Murakami et al. . | |
| 5,095,811 | 3/1992 | Shutic et al. | 454/52 |
| 5,356,335 | 10/1994 | Matsui et al. | 454/52 |
| 5,480,349 | 1/1996 | Kolta | 454/52 |

FOREIGN PATENT DOCUMENTS

| | | | |
|---|---|---|---|
| 0 026 359 | 4/1981 | European Pat. Off. | 118/326 |
| 2 119 920 | 11/1983 | United Kingdom | 454/52 |

*Primary Examiner*—Harold Joyce
*Attorney, Agent, or Firm*—Kennedy,Davis & Kennedy, P.C.

[57] ABSTRACT

A paint spray booth (10) has a spray chamber (11), an air make-up unit (15), and an air exhaust system with an exhaust air fan (26) and an exhaust damper (25). The booth has a pressure transducer (29) that senses the pressure of air both inside and outside the booth and which transmits control signals indicative of sensed changes in the differential air pressure to motors that drive the exhaust fan or the exhaust damper. In this manner the exhaust air flow rate is adjusted to compensate for changes in the differential air pressure.

8 Claims, 1 Drawing Sheet

PAINT SPRAY BOOTH

TECHNICAL FIELD

This invention relates generally to paint spray booths such as those used in spray painting vehicles, and particularly to systems and method of controlling air flow through such booths.

BACKGROUND OF THE INVENTION

Both new and used automotive vehicles are typically coated with paint in spray booths. These booths are equipped with air conditioning means whereby the booth is continuously supplied with fresh, filtered air from ambience which is discharged back to ambience through air exhaust filters, and with means for heating the air for paint bake cycles. Since the vehicle bodies are sprayed with paint, proper control of the flow of air within the booth is necessary in order to provide uniformity of the sprayed coatings. For example, if the flow of air in the booth is more rapid over one area of the body being painted than another, where both areas are being sprayed equally, more paint will be applied to the body where the flow rate is slower than to the other. Also, as the air filters in the air intake and air exhaust conducts and plenums accumulate filtrates, such effects the overall flow rate of air through the filters and thus through the booth. This in turn yields lack of uniformity in coatings applied during different time intervals. The opening and closing of the booths to permit ingress and egress of automobiles and workers into and out of the booths, also effects uniformity. Variations in air flow stirs up sedimentation and dust which almost invariably has necessitated that each coating applied to a body must be sanded or buffed to rid the coatings of unsightly impurities.

Heretofore, the just described problems associated with paint spray booths have been attacked in several different manners. Exemplary of such approaches are those disclosed in U.S. Pat. Nos. 4,261,256, 4,685,385, 4,721,033, 4,729,295, 4,840,116, 5,095,811, 5,356,335 and 5,480,349. These have included means for varying the speed of air extractors so that air removal is adjusted automatically as a function of the volume of air drawn into the booth ('256). However, this system employs air flow velocity sensors which do not account for air flow rate changes made merely by changes in the size or shape of the automobile being painted. The booth floors have also been provided with air permeable sections designed to reduce the turbulence of the exhaust air flow around the body being sprayed ('385). The '033 patent discloses means for controlling the outlet paths of air flow dependant on the volume of air being exhausted. The '295 system adjusts air flow velocity in response to changes in detected air flow through booth filters. The '116 system adjusts feed air in adjacent longitudinal zones of the booth so as to maintain air flow velocity within a range start-up, shutdown and steady booth operations. In the '811 disclosure the problem of downdrafts is addressed while the '335 patent disclosure provides a pressure gradient control system between adjacent booth zones. The '349 patent also provides means for controlling the velocity of air flow through different areas in response to changes in air pressure in one of two plenums.

Though the just described paint booth air control systems have been effective in alleviating some problems associated with air induced type spray paint booths, there has continued one problem that has been so persistent as to have been simply accepted and thus essentially no longer consciously recognized as a problem at all. That has been the fact that spray coatings have had to be sanded or buffed after baking. However, if coatings could be applied substantially free of impurities, then buffing, a labor intensive operation, could be substantially eliminated.

SUMMARY OF THE INVENTION

It has now been discovered that the flow of air through a spray paint booth can be controlled in a manner that reduces the presence of impurities in the sprayed coating to a level where buffing is no longer normally required. This is achieved by controlling the rate of flow of the air exhaust stream in response to changes in the differential between booth air pressure and ambient air pressure. This is done by sensing this differential in air pressure and controlling the speed of an exhaust fan or the position of an air exhaust damper in response to changes in the sensed pressure differential so as to maintain the differential at a desired constant level.

DETAILED DESCRIPTION

Figure 1:
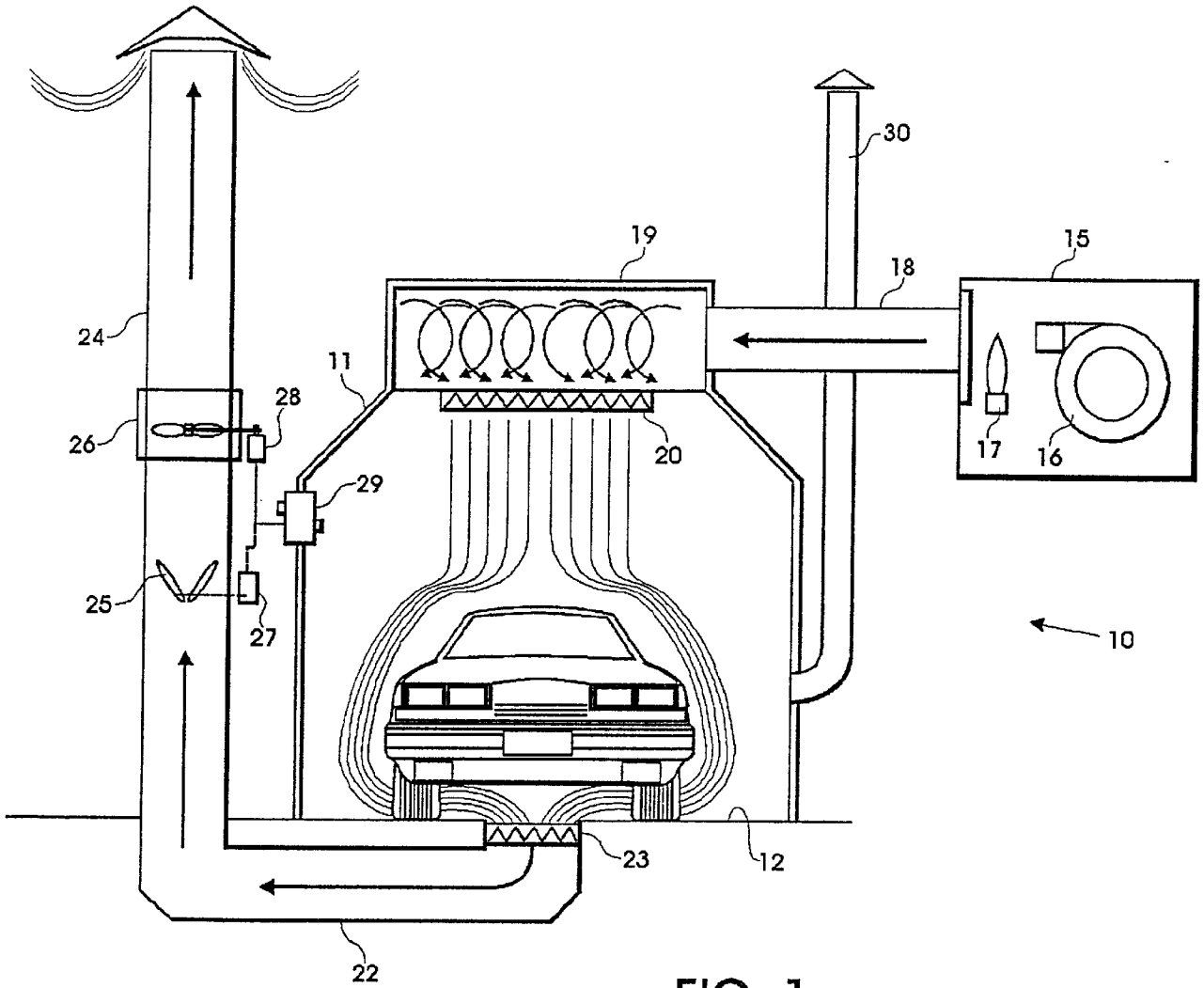
FIG. 1 is a schematic illustration of a spray paint booth that embodies principles of the invention in a preferred form.

With reference next to the drawing, there is shown a paint spray booth 10 having an enclosed spray chamber with walls 11 and a floor 12 shown with an automobile located therein for painting. For size perspective a typical booth can measure 14 feet wide by 28 feet long and by 10 feet high.

An air condition system is provided for drawing air into the spray chamber from ambience and for returning the air to ambience and also for heating the air to bake sprayed coatings. This system includes an air make-up unit 15 that houses a squirrel-cage type centrifugal blower 16, which is in fluid communication with ambience, and a burner 17. A duct 18 provides fluid communication between the make-up unit 15 and a plenum 19 mounted in the chamber ceiling over an intake filter 20.

The air exhaust system has an exhaust pit that opens into the floor of the spray chamber where an exhaust air filter 23 is mounted. The pit communicates with an upright exhaust stack 24 having its top open to ambience. A damper 25 is adjustably mounted in the stack beneath an exhaust fan 26. The damper is positionable by a conventional pneumatic actuator 27 while the fan is driven at variable speeds by an AC motor 28 with a variable speed drive. Each of these is electrically coupled with a double port pressure sensor and transducer 29 that is mounted to a chamber wall with one port open to the inside of the chamber and with the other port open to ambience. Finally, a conventional bake exhaust stack 30 is also shown but is no longer required, as later explained.

Where the booth is located inside another, larger building such as an automotive assembly plant, the stacks 24 and 30 extend through the roof of the larger building. In this case booth ambience herein refers to the air space outside of the booth but inside the surrounding building since the air pressure inside the building may vary from that outside of the building.

The system illustrated in FIG. 1 shows both the exhaust damper 25 and the exhaust fan 26 as being variably adjusted in response to signals received from the differential pressure sensor and transducer 29. However, it should be understood that only the exhaust damper or the exhaust fan may be so controlled by the pressure sensor and transducer. Indeed, at the present time preferably only the exhaust fan is coupled with the sensor for simplicity and reliability of construction and operation.

The differential pressure sensor and transducer 29 may be a two air port type PX 656 pressure transducer sold by Omega Technologies Company which has a pneumatic range of −0.05 to +0.05 inches water column. It is powered by a 24VDC power supply such as that which generates an output control signal of 4 to 20 milliamps DC in controlling the speed of the exhaust fan 26. The fan itself is power driven here by a three-phase, 240 VAC variable speed drive which performs a conventional PID equation to determine output power changes. The sensor/transducer 29 produces an electric signal proportional to the differential pressure which is compared with an internal setpoint in the power controller which may be in the variable speed drive. A Danfoss VLT Series 3000 is preferred. An internal setpoint of positive 0.025 in/wc pressure is also preferred. This, for example, may be done by increasing the speed of the exhaust fan from say 3050 RPM to 3100 RPM to maintain the pressure inside the booth at 0.025 in/wc above ambient pressure. The specific values selected are, of course, dependant upon the size of the booth and number and size of the air exhaust stacks employed. The guiding principle here however is to adjust the exhaust air flow rate to compensate for changes in pressure differential such that as the differential rises the flow rate of exhaust air increases and vice versa until the differential returns to the desired level. The ideal relationship here for any particular booth, and indeed for any particular object to be repetitively painted in a spray paint booth, may be best determined empirically. Though a slight positive booth pressure is normally desired, e.g. +0.05 in/wc for some applications, it could be at desired zero level or even negative.

During operation the pressure differential between the air pressure inside and the air pressure outside the booth varies. This is caused by changing dynamics in air flow circulation. For example, as the air intake filter 20 extracts and accumulates filtrates from the air drawn into the booth, the flow of air through the filter becomes more restricted which in turn increases the pressure differential. As the exhaust air filter 23 accumulates filtrates, mostly from the paint spray, it too impedes the flow of exhaust air. When the booth air is heated by the burner 17 during paint bake cycles the fan efficiency curve changes. The increase in temperature within the booth over that outside the booth also affects the air pressure differential. The opening and closing of the doors to the booth to permit the entry and exit of automobiles and people also momentarily changes the air pressure differential.

It is believed that the turbulence created by such changes is what has heretofore primarily caused airborne particles to impinge upon wet paint coatings so as to necessitate buffing following the bake cycles. By adjusting exhaust air flow in response to changes in the pressure differential, the pressure differential can be maintained substantially constant and turbulence thereby substantially eliminated. But regardless of the reason, the dried coatings have in fact surprisingly been found to be sufficiently free of impurities as not to normally require sanding or buffing. This in turn provides a major reduction in costs.

With the just described system and method a selected air pressure differential can be maintained so as to avoid turbulence within the booth chamber. This can be done notwithstanding the opening and closing of booth doors, changes in booth temperature made between spray and bake cycles, the placement of differently sized and shaped objects into the booth for painting, rapid changes in ambient air pressure as when building or plant fans or doors are activated, wind shear at the exhaust stack, wind forcing excessive air into the air make-up unit, and filter contamination. The system can be easily retro-fitted to existing spray paint booths.

The system has also been found to enable use of the exhaust fan 26 to control bake cycle air removal, thus eliminating the need for bake cycle fans in the bake exhaust stack 30. Indeed, even the presence of an exhaust stack can be eliminated since the speed of the fan 26 can be increased sufficiently in insure that the volatiles created during bake are sufficiently removed. This is simply a by-product that advantageously occurs as the fan speed is increased with the rise in temperature during bake in response to the change in differential pressure. Fan cavitation has also been essentially eliminated which creates turbulence. The exhaust fan automatically slows to adjust pressure when a booth door is opened. In prior booths however the normally positive booth pressure neutralized thereby enabling contaminants to be drawn into the booth during pressure changes. More importantly, the proper pressure differential is evenly maintained during bake cycles when trash is most often deposited on fresh paint. This has been caused by the booth pressure becoming too positive due to insufficient exhaust. The system is also highly efficient which can reduce utility costs. Indeed, it is so effective that quality control reworks can be reduced from a 90% requirement level to less than 15% which equates to tremendous savings.

It thus should be understood that the just described embodiment merely illustrates principles of the invention in its preferred form. Though the booth has been shown used for painting automobiles, it may be used for painting any number of other products. Thus, many changes, additions, and deletions may be made thereto without departure from the spirit and scope of the invention as set forth in the following claims.

I claim:

1. A paint spray booth comprising a spray chamber; an air intake conduit in fluid communication with said chamber; an air exhaust conduit in fluid communication with said chamber; means for sensing the differential in the pressure of air inside said chamber and the pressure of air outside said chamber; and control means for controlling the flow of air through said air exhaust conduit in response to changes in inside and outside air pressure differentials sensed by said sensing means.

2. The paint spray booth of claim 1 wherein said air flow control means comprises a variably speed fan.

3. The paint spray booth of claim 1 wherein said air flow control means comprises a variable positionable damper.

4. The paint spray booth of claim 1 wherein said chamber has a wall and wherein said differential air pressure sensing means is mounted on said wall in sensed communication with air pressure on the inside of said wall and air pressure on the outside of said wall.

5. A method of controlling the flow of air within a spray paint booth having an intake air stream flowing from ambience into the booth and an exhaust air stream flowing from the booth to ambience, and wherein the rate of flow of the exhaust air stream is controlled in response to changes in the differential between booth air pressure and ambient air pressure so as to maintain a substantially constant differential between booth air pressure and ambient air pressure.

6. The method of claim 5 wherein the pressure of air inside the booth and the pressure of air outside the booth is continuously sensed.

7. The method of claim 5 wherein the flow rate of the exhaust air stream is controlled by a fan.

8. The method of claim 5 wherein the flow rate of the exhaust air stream is controlled by a damper.

* * * * *